US005489567A

United States Patent [19]

Koshizuka et al.

[11] Patent Number: 5,489,567

[45] Date of Patent: Feb. 6, 1996

[54] METHOD FOR TREATING THERMALLY TRANSFERRED IMAGE

[75] Inventors: Kunihiro Koshizuka; Shigehiro Kitamura; Masataka Takimoto; Tomonori Kawamura, all of Hino, Japan

[73] Assignee: Konica Corporation, Tokyo, Japan

[21] Appl. No.: 320,180

[22] Filed: Oct. 7, 1994

[30] Foreign Application Priority Data

Oct. 15, 1993 [JP] Japan ..... 5-258397

[51] Int. Cl.[6] ..... B41M 5/035; B41M 5/38

[52] U.S. Cl. ..... 503/227; 428/195; 428/913; 428/914; 428/484; 428/488.1

[58] Field of Search ..... 428/195, 913, 428/914, 484, 488.1; 8/471; 503/227

[56] References Cited

U.S. PATENT DOCUMENTS 5,220,343 6/1993 Takanashi et al. ..... 346/1.1

FOREIGN PATENT DOCUMENTS 0251170 1/1988 European Pat. Off. ..... 503/227

2-182467 7/1990 Japan ..... 503/227

*Primary Examiner*—B. Hamilton Hess

*Attorney, Agent, or Firm*—Frishauf, Holtz, Goodman, Langer & Chick

[57] ABSTRACT

A method for treating á thermally transferred image is disclosed. The method comprising the steps of (1) thermally transferring an image from the ink layer of a ink sheet which comprises a support and a ink layer comprising a sublimation dye provided on the support, to the surface of an image receiving layer of a image receiving element which comprises a support and a image receiving layer provided on the support, by means of imagewise heating by a first thermal head, and (2) heating the surface of the image receiving layer having the transferred image by a second thermal head through a plastic film contacted to the surface of the image receiving layer.

6 Claims, 6 Drawing Sheets

METHOD FOR TREATING THERMALLY TRANSFERRED IMAGE

FIELD OF THE INVENTION

The present invention relates to an a method for creating a thermally transferred image method and more particularly to an image treating method capable of raising the processing speed, quality and durability of an image formed by sublimation type thermal transfer.

BACKGROUND OF THE INVENTION

There have come widely used in recent years a variety of cards represented by licenses such as driver's licenses, identification cards, membership cards with a photograph, certification cards and name cards with a photograph.

On the surface of these cards, or image receiving bodies, an image of the owner's face is often formed for identification. Since such an image of a person's face has gradation, it is also referred to as a gradation containing image. Such a gradation containing image,is not limited to an image of a person's face, and as long as an image has gradation, it is called a gradation containing image.

It is well known that an image formed of a sublimation dye can be improved in fixedness and color tone by subjecting it to surface heat treatment. As a typical conventional technique for such heat treatment, Japanese Pat. O.P.I. Pub. No. 55870/1992 proposes to carry out heat treatment, after thermally transferring a sublimation dye from a transfer sheet onto an image receiving element using a thermal head, by applying heat to the image surface through dye-unapplied portions of the transfer sheet using the same thermal head as the above. However, conducting image formation with a sublimation dye and heat treatment of a resulting image using the same thermal head has a disadvantage of requiring a longer processing time, because a sheet carrying a thermally transferred image has to be turned back again in the reverse direction for each image to receive heat treatment. Further, in carrying out heat treatment, the heat energy applied to a thermal head is greater than that appropriate to form an image effectively; therefore, the heating resistor of such a thermal head cannot be cooled adequately after the heat treatment and thereby accumulates heat in continuous processing. When a thermally transferred image is formed using such a heat accumulating thermal head, heat energy is excessively applied to unnecessary portions of an image forming area, producing unnecessary densities, or so called fog, in the high light portions of an image. This is another disadvantage involved in this technique.

Further, for the purpose of protecting an image formed, there are known a technique to conduct thermal transfer of a transparent resin film onto an image as well as a technique to form a cured resin coating on an image by coating an active energy ray curable resin and irradiating it with a necessary amount of active energy rays. The latter technique has advantages of providing good scratching resistance and solvent resistance, but it has a problem that when an active energy ray curing resin layer is provided on an image formed of a sublimation dye, the combination of the dye and the active energy ray curable resin affects curing properties of the layer, causing a large drop in curing speed or curing failure.

For example, when a cation-polymerizable epoxy-type ultraviolet-curable resin is coated on an image formed of an anionic sublimation dye, the dye inhibits the polymerization under the irradiation of ultraviolet rays, lowering the reaction speed and thereby giving an inadequately cured coating.

SUMMARY OF THE INVENTION

The object of the invention is to solve the above problems and provide an image treating method capable of raising the treating speed, quality and durability of an image formed.

The above object of the invention is attained by a method for treating a thermally transferred image comprising the steps of (1) thermally transferring an image from the ink layer of a ink sheet which comprises a support and a ink layer comprising a sublimation dye provided on the support, to the surface of an image receiving layer of a image receiving element which comprises a support and a image receiving layer provided on the support, by means of imagewise heating by a first thermal head, and (2) heating the surface of the image receiving layer having the transferred image by a second thermal head through a plastic film contacted to the surface of the image receiving layer.

DETAILED DESCRIPTION OF THE INVENTION

Figure 1:
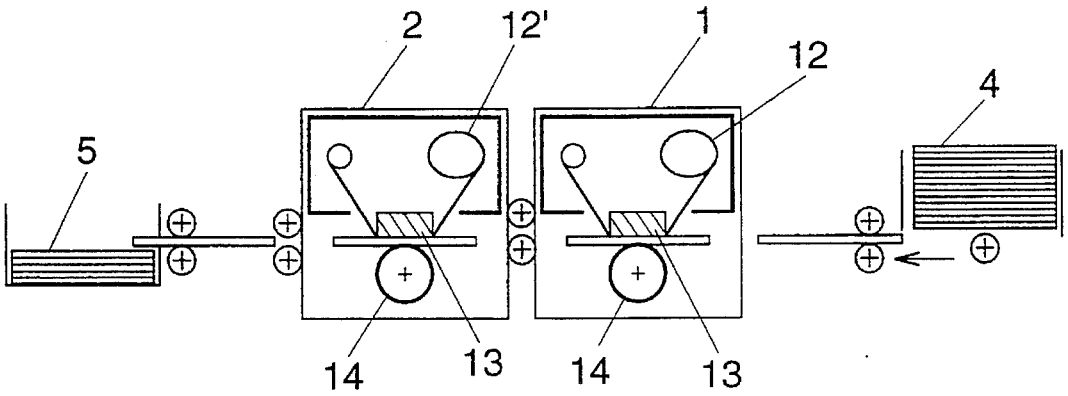
FIG. 1 is a schematic diagram of the image treating method of the invention.

In the image treating method of the invention, the surface of an image receiving layer of an image receiving element comprising a support and the image receiving layer provided on the support is first brought into contact with an ink layer of an ink sheet comprising a support having thereon the ink layer containing sublimating dyes, and then heat is applied imagewise to the ink sheet through the support of the ink sheet by a first thermal head so that the sublimating dyes contained in the ink layer is transferred onto the image receiving layer for forming an image. In the preferable embodiment of the invention, an image formed in the process described above is one containing gradation information such as a photographic image.

In the next stage, a plastic film is placed on the surface of the image receiving layer having thereon the image obtained in the above-mentioned manner and then heat is applied evenly by the second thermal head through the back of the plastic film, namely through the surface of the plastic film opposite to its surface that is in contact with the image receiving layer so that the image on the image receiving layer may be processed thermally. Owing to the process mentioned above, it is possible to process images continuously and efficiently and to improve fixation characteristic and color tone, without being accompanied by the problems such as a lowering of efficiency caused by conveying reversely the image receiving element to the position of the first thermal head after image transferring and occurrence of fog caused by heat accumulated in the thermal head, which has been impossible to avoid in the conventional method wherein the same thermal head is used for both the transfer stage and the thermal processing stage.

As a preferable embodiment of the invention, there is a method wherein a hot melt ink layer is provided on a part of the surface of the aforementioned plastic sheet, namely on a part of the surface that is in contact with the image receiving layer, the surface of the image receiving layer is brought into contact with the hot melt ink layer, and heat is applied imagewise thereto through the back of the ink layer by the second thermal head mentioned above so that hot melt ink images may be transferred onto the surface of the image receiving layer, and further a portion having no hot melt ink layer on the plastic sheet is brought into contact with the image receiving layer and heat is applied evenly through the back of the plastic sheet by the second thermal head so that the transferred images with gradation may be stabilized. Though any image can be transferred by means of hot melt ink, character images are preferable. The method mentioned above makes it possible to compose easily and simply the images having therein both images having gradation on the image receiving element and character images. In this process, both of the step of evenly heating to the transferred sublimation dye image and the step of transferring the heat melt ink image may be carried out by the same thermal head, the second thermal head, because the heating time necessary for transfer the image of heat melt ink image is very short. Therefore, heat accumulation in the thermal head is a little and does not cause any problem such as fogg formation.

It is preferable to provide a protective layer on the surface of the images obtained through the method mentioned above. As the protective layer, the preferable one is an active-energy-cured resin layer that is formed by coating directly active-energy-curable resins on the surface of an image receiving layer and by irradiating them with active energy rays to cure them. Further, the protective layer used preferably is a substantially transparent thermoplastic resin layer that is formed through the method wherein the surface of an image receiving layer is kept to be in contact with a resin layer transfer sheet having on its support a substantially transparent thermoplastic resin layer, and heat is applied thereto through the back of a heat transfer sheet so that the thermoplastic resin layer may be transferred to the surface of the image receiving layer. It is further preferable to form a strong protective layer that a layer of the active-energy-cured resin layer is provided on the thermoplastic protective layer provided on the surface of image receiving layer.

When forming a protective layer by coating active-energy-curable resin directly on the surface of an image receiving layer, it is preferable to use cationic dyes as the sublimable dye which do not cause an impediment of curing of active-energy-curable resin that is usually caused by dyes.

In the heat treating process of the invention, it is preferable that 25 to 500 mJ/mm$^2$ of thermal energy is applied for a time of 0.1 to 10 milisecond to a sublimation dye image transferred on a image receiving layer. In the thermal head used for a heating treatment (second thermal head), it is effective, from the viewpoints of smoothing of an image surface and efficiency of energy to be supplied as well as the heat processing speed, to use a thermal head having an element area that is greater than that of a heat-generating resistor in a thermal head (first thermal head) used for forming a sublimation thermal transfer image.

For example, when assuming that a length in the primary scanning direction is m1 and a length in the secondary scanning direction is s1 for a heat-generating resistor in a thermal head used for forming a sublimation type thermal transfer image, while a length in the primary scanning direction is M1 and a length in the secondary scanning direction is S1 for a heat-generating resistor in a thermal head used for heat processing, the relation of s1<S1 and/or m1<M1 is preferable. In the concrete example, when the resolution of a thermal head used for forming a sublimation type thermal transfer image is 16 m/dot, the resolution of a thermal head used for heat processing is 12 m/dot.

Further, from the viewpoint of smoothing of an image surface and efficiency of energy to be supplied, it is effective that a conveyance distance of a thermal transfer image receiving object sent out within a period of unit cycle is shorter than a length in the secondary scanning direction of a heat-generating resistor in a thermal head. The reason for the above is that the frequency of heating the surface of an image receiving layer where an image is formed is increased when a small part of a portion to be impressed during each cycle is superposed on the other, thereby an amount of energy to be supplied to a unit area is increased. When assuming that a length in the secondary scanning direction of a heat-generating resistor is L1 and a conveyance distance of an image receiving object sent out during one cycle is L2, the relation between L1 and L2 is represented by L2/L1>1, preferably by $10 \geqq L2/L1 \geqq 1.1$ and more preferably by $5 \geqq L2/L1 \geqq 1.3$. When the value of L2/L1 is large, the effect is exhibited remarkably, but when the value is too large, a long time is required for heat treatment.

A typical embodiment of the invention is illustrated with drawings. FIG. 1 shows a typical example of the image processing method according to the invention, where an image receiving element delivered from card stocking unit 4 is brought into contact with sublimation ink sheet ribbon 12 in sublimation image printing unit 1, and an image record is made in the form, for example, of lattice shown in 15 of FIG. 7 according to the signal of thermal head 13. Then, the sheet is conveyed by rollers to heat treating unit 2, where it is brought into contact with plastic film 12' for heat treatment and character image formation. Ink sheet 12' comprises a plastic film support provided with heat fusible ink layer 11 in part for each imaging unit of an image receiving element. Examples of the pattern are shown in (a) to (d) of FIG. 6. After image recording and character recording, the image receiving element is stocked in processed card discharging unit 5.

Figure 2:
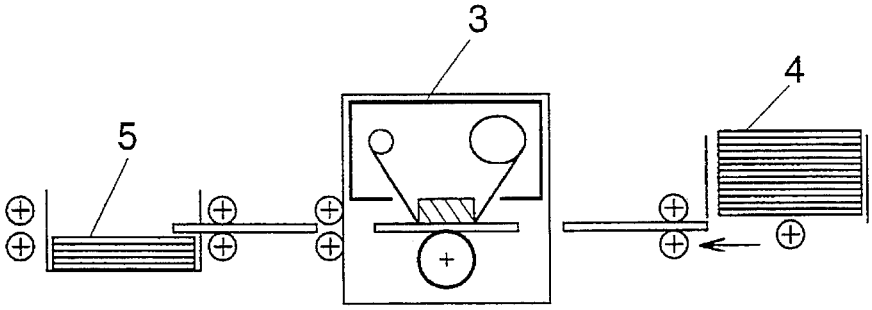
FIG. 2 is a schematic diagram of the image treating method used in Comparative Example 1.

FIG. 2 shows a printer used in a conventional image processing method, in which a sublimation dye image processing unit and a heat treating unit are provided at the same position, and image recording and character recording are carried out simultaneously.

Figure 3:
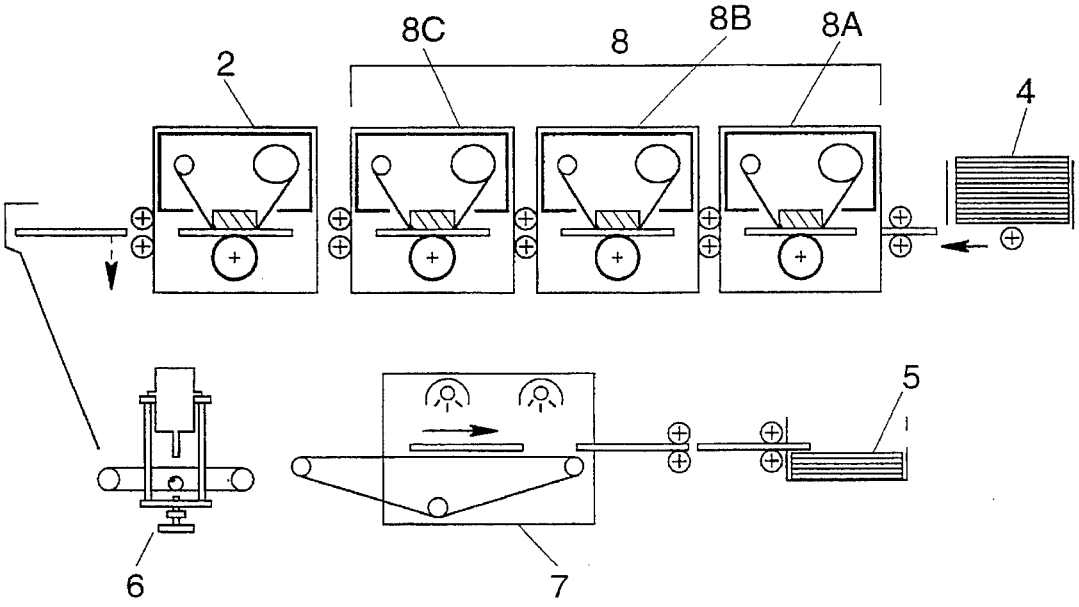
FIG. 3 is a schematic diagram of the image treating method of the invention employing an additional unit for the formation of an active energy ray curing resin layer.

FIG. 3 shows a schematic diagram for preparing a protective layer, where an image receiving element subjected to image recording and character recording in the equipment of FIG. 1 is introduced into active energy ray curing resin coating unit 6 and coated with resin. The resin is cured in active energy ray irradiating unit 7 and, then, the sheet is discharged to processed card discharging unit 5.

Figure 9:
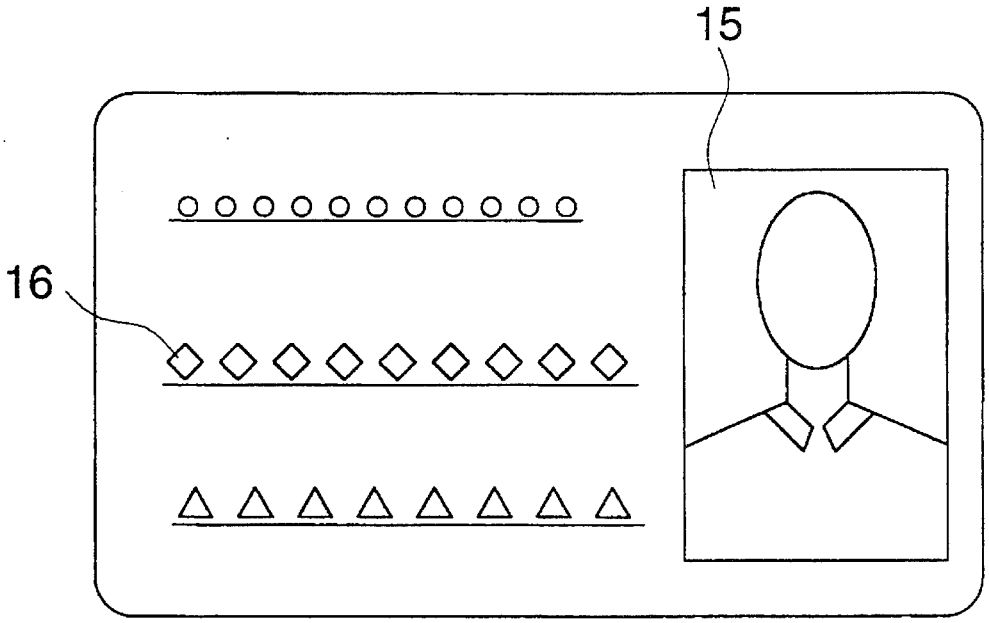
FIG. 9 shows an example of image recording and character recording carried out according to the invention.

In the case of color image recording, sublimation image printing unit 8 has three image printing units of yellow 8A, magenta 8B and cyan 8C, in which a color image is formed, and character recording is carried out in the same heat treating unit as in FIG. 1. Subsequently, a protective layer for color image is transferred in the transferring unit 9 for thermal transfer protective layer. FIG. 5 is a schematic diagram of a typical system comprising the equipment shown in FIG. 4 and active energy ray curing resin coating unit 6 added thereto. By the above-mentioned method a heat-transferred picture which has both of an image with gradation and a character image, such as shown in FIG. 9, can be prepared.

Subsequently, the materials used in the invention are described.

Image Receiving Element

The image receiving element of the invention comprises a support and an image receiving layer provided on the support's surface.

The support of the image receiving element may be any of those including various types of paper such as paper, coated paper and synthetic paper, i.e., a composite material obtained by bonding polyethylene, polypropylene or polystyrene to paper; various plastic films or sheets such as polyvinyl chloride type resin sheets, ABS resin sheets, polyethylene terephthalate based films and polyethylene naphthalate based films; films or sheets formed of various metals; and films or sheets formed of various ceramics.

In any case, the thickness of a support is usually 20 to 1000 μm and preferably 20 to 800 μm.

The composition of the image receiving layer is not particularly limited as long as the image receiving layer can receive a sublimation dye which diffuses upon heating from the ink layer of an ink sheet for sublimation type thermal transfer recording. Basically, the layer is formed of a binder and a variety of additives.

The thickness of an image receiving layer formed on the surface of a support of image receiving body is generally 1 to 50 μm, preferably 2 to 20 μm.

Binders suitable for the image receiving layer of the invention include a variety of binder resins such as polyvinyl chloride resins, polyester resins, polycarbonate resins, acryl resins and many heat resistant resins.

A peeling layer may be provided on a portion of the surface of image receiving layer by coating a solution or a dispersion of a peeling agent in a suitable solvent and drying it. In this case, solid waxes such as polyethylene waxes and polypropylene waxes are preferably employed. These peeling agents can be used as a mixture with an ethylene acrylic acid type resin or a polyvinyl chloride type resin.

Ink Sheet for Sublimation Type Thermal Transfer Recording

A gradation information containing image can be formed on the image receiving layer by use of an ink sheet for sublimation type thermal transfer recording.

The ink sheet for sublimation type thermal transfer recording comprises a support and a sublimation dye containing ink layer provided thereon.

The support for ink sheet is not particularly limited in material as long as it has adequate dimensional stability and withstands the heat applied by a thermal head during recording, and conventional ones can be employed. The ink sheet may be a monochromatic one; but, in forming a color image, the so-called frame sequential ink sheet, in which ink layers of yellow, magenta, cyan and black are sequentially provided on one ink sheet in a size of imaging area, is thermally transferred with a single thermal head, or ink sheets of yellow, magenta, cyan and black are each thermally transferred with thermal heads corresponding to the respective ink sheets.

The sublimation dye containing ink layer basically contains a sublimation dye and a binder for ink sheet.

Such a sublimation dye is used in an amount of usually 0.1 to 2.0 g, preferably 0.2 to 5 g per square meter of ink sheet support.

Binders suitable for sublimation ink layer include, for example, cellulosic resins such as cellulose addition compounds, cellulose esters and cellulose ethers; polyvinyl acetal resins such as polyvinyl alcohols, polyvinyl formals, polyvinyl acetoacetals and polyvinyl butyrals; vinyl type resins such as polyvinyl pyrrolidones, polyvinyl acetates, polyacrylamides, styrene type resins, poly(meth)acrylate type resins, poly(meth)acrylic acids and (meth)acrylic acid copolymer resins; rubber type resins; ionomer resins; polyolefin type resins; and polyester resins.

Among these resins, polyvinyl butyrals, polyvinyl acetoacetals and cellulosic resins are preferred for their high storage stability.

These binders can be used singly or in combination of two or more kinds.

The ratio of the binder to the heat diffusible dye is preferably in the range of 1:10 to 10:1 and more preferably in the range of 2:8 to 7:3 in weight.

Further, various additives may be added to the ink layer.

Suitable additives include peeling materials such as silicone resins, silicone oils (including reaction curing type), silicone modified resins, fluororesins, surfactants and waxes; fillers such as metal fine powders, silica gels, metal oxides, carbon blacks and resin fine powders; and curing agents reactive to the binder components including isocyanates and radiation active compounds such as acrylics and epoxides.

When the image to be formed is monochromatic, the sublimation dye contained in the ink layer may be any of the yellow dyes, magenta dyes and cyan dyes.

Two or more of the above three types of dyes may also be contained according the color tone of the image to be formed.

When an active energy ray curing resin protective layer is provided directly on a sublimation dye image formed according to the invention, using a cationic sublimation dye is preferred in view of curing properties of the resin when irradiated with active energy rays.

As the cationic dye, conventional ones can be used without particular limitation.

The ink sheet for sublimation type thermal transfer recording can be manufactured by dispersing or dissolving the above ink layer components in a solvent to prepare a coating solution for ink layer formation, coating the solution so prepared on the surface of a support for ink sheet and drying it. The thickness of the ink layer thus formed is usually 0.2 to 10 μm and preferably 0.3 to 3 μm.

The ink layer of the ink sheet for sublimation type thermal transfer recording is brought into contact with the image receiving layer and, then, heat energy is applied imagewise to the ink layer, so that the sublimation dye contained in the ink layer vaporizes or sublimates in an amount corresponding to the heat energy applied and transfers to the image receiving layer, where it is received to form an image.

Plastic film for Heat Treatment

As the plastic film for heat treatment for transferred sublimate dye image, it is possible to use heat-resisting plastic films such as those of polyethyleneterephthalate, polyethylenenaphthalate, polyamide, polyimide, polycarbonate, polysulfone, polyvinylalcoholcellophane and polystyrene.

The thickness of a support is preferably within a range from 2.0 μm to 10.0 μm.

On the plastic film, a patterned fusible ink layer is preferably provided.

Figure 6:
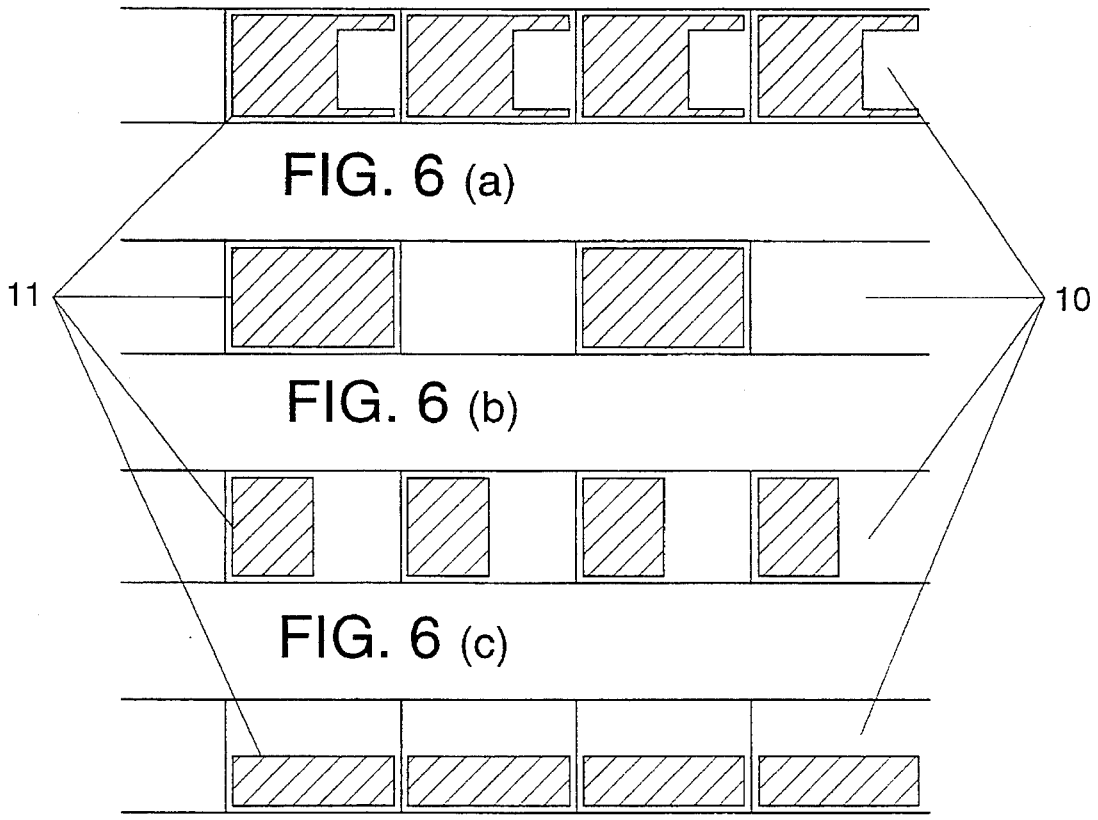
FIG. 6 shows examples of heat fused thermally transferred ink portions and their patterns employed in the invention.

The heat fusible ink layer is provided on the film in pattern for each imaging area of an image receiving element. This heat fusible ink layer can be provided in pattern on a portion of each imaging area of an image receiving element as shown in a, b and c of FIG. 6, or alternately with a non-ink portion on the whole area of an image receiving body as shown in d of FIG. 6. In FIG. 6, 10 is the non-ink layer portion of the plastic film to be used for heating the sublimation dye image on the receiving layer, and 11 is the heat fusible ink layer for forming character images on the receiving layer. In order to prevent the heat fusion between the support and the thermal head due to the energy applied by the thermal head, it is preferred that an antisticking layer be provided on the support oppositely with the ink layer.

The plastic film preferably has an antisticking layer on the surface to be faced to second thermal head, which has a heat resistivity and a rubricity to prevent sticking the film with the thermal head. The antisticking layer can be formed with composition that can prevent the sticking phenomenon and is known widely itself. For example, it is preferable to form it with resin composition containing (A) resin of a silicone resin type, (B) at least one kind of resin selected from a group including polyester resin, polyamide resin, cellulose resin, acryl resin and fluorine resin, and, (C) polyisocyanate resin.

As the silicone resin mentioned above, silicon denatured resins such as those represented by the following formula is usable.

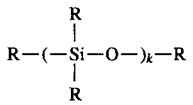

wherein, R represents an organic group, and k represents integers of not less than 1, The resins include, for example, organopolysiloxane, denatured polysiloxane resin, silicon denatured acryl resin, silicon denatured urethane resin, silicon denatured urea resin, and silicon denatured epoxy resin can be used preferably. These silicon denatured resins are those obtained by denaturing acryl resin, urethane resin, urea resin and epoxy resin, for example, with polysiloxane.

In the aforementioned various silicon denatured resins, the content of a silicon portion is normally within a range of 1 to 90% by weight and preferably within a range of 5 to 50% by weight.

These silicone resins may be used either independently or in combination of two or more kinds thereof.

Among the various silicone resins mentioned above, the aforementioned various silicon denatured resins are preferable.

It is preferable that the silicone resins mentioned above are hardened by cross-linking agents.

Incidentally, the cross-linking agent mentioned above is not restricted in particular, and isocyanates, azyridines and epoxies are given.

The content of the aforesaid silicone resins in the antisticking layer is normally within a range of 1 to 100% by weight and preferably within a range of 10 to 80% by weight.

The polyester resins mentioned above are not restricted in particular provided that they are represented by those which are generally called thermoplastic polyesters.

The polyamide resins mentioned above are not restricted in particular, and nylon 6, nylon 8, nylon 11, nylon 66 and nylon 610, for example, are given. In addition, copolymers can also be used.

As the cellulose resins mentioned above, cellulose ester such as acetylcellulose, nitrocellulose and acetylbutylcellulose and cellulose ether such as ethylcellulose, methylcellulose, benzylcellulose and carboxymethyl cellulose, for example, may be given.

As the acryl resins mentioned above, there may be given, for example, homopolymers of methylacrylate, ethylacrylate, methylmetacrylate, ethylmetacrylate, acrylonitrile, acrylamide and derivatives thereof, and copolymers of both aforementioned various acryl monomers and vinyl acetate, vinyl chloride, styrene or maleic anhydride.

As the fluorine resins mentioned above, there may be given, for example, tetrafluoroethylene resin, tetrafluoroethylene/hexafluoropropylene copolymerization resin, tetrafluoroethylene/perfluoroalkoxyethylene copolymerization resin, trifluorochloro ethylene resin, tetrafluoroethylene/ethylene copolymer, vinylidene fluoride and vinylfluoride resin.

These fluoride resins may be used either independently or in combination of two or more kinds thereof.

The aforesaid various resins can either be added while they keep the state of resins so that they may be contained evenly in hardened antisticking layer or be contained in the antisticking layer while they keep the state of fine powder.

The aforementioned antisticking layer may further contain fluorine resin particles, metallic powder, inorganic or organic fine particles such as silica gel, surfactants, and lubricants.

The antisticking layer may contain additives such as wax, surfactants, higher fatty acid derivatives, higher fatty acid alcohol, higher fatty acid ether and phosphoric ester, in addition to the aforesaid components.

The ratio of the components mentioned above for forming the antisticking layer may be determined appropriately.

The antisticking layer is formed on the surface of the outermost layer of a heat-sensitive recording material by the use of, for example, a coating method employing a solvent.

The thickness of the antisticking layer is allowed to be not less than 0.01 μm, but it is 0.03 to 30 μm practically.

A character containing image can be formed by heating imagewise an ink layer partially provided on the plastic film for heat treatment, which comprises a support and a heat fusible ink layer partially provided thereon in pattern, using a thermal head, so that the heat fusible ink is fused and transferred to the image receiving layer.

Protective Layer Transfer Sheet

In the embodiment of the invention, an image protection layer can be formed with a transfer sheet for image protection. In forming an image protection layer, the protective layer transfer sheet for image protection is heated and pressed on the surface of a gradation containing image; as a result, a substantially transparent thermoplastic protective layer is transferred onto the image surface. A typical example of the transfer sheet for image protection comprises a support for transfer sheet and a transferable image protecting resin layer provided thereon.

The support used in the protective layer transfer sheet for image is not particularly limited in material as long as it is formed of a material having good heat resistance and capable of carrying a transfer sheet for image protection. Suitable examples include a variety of plastic films and sheets such as polyvinyl chloride resin type sheets, ABS resin sheets, polyethylene terephthalate based films and polyethylene naphthalate based films; and films and sheets formed of metals. The thickness of such films is usually 3 to 50 μm and preferably 6 to 30 μm.

The protective layer transfer sheet has an area necessary for covering a sublimation type thermal transfer image. A size of the area is determined appropriately depending on a size of an image receiving element on which the protective layer to be transferred.

It is preferable that a stripping layer is provided between the protective transfer resin layer and a support for the purpose of enhancing the separability. The stripping layer preferably comprises polyvinylacetal resins, ethylcellulose resins or acryl resins. The content of these resins is normally 5 to 100% and preferably 20 to 100%. The thickness of the stripping layer is normally 0.2 to 3.0 μm and preferably 0.3 to 2.0 μm.

In the protective layer transfer sheet, it is preferable that a resin layer to be transferred is given a property of cushion so that the resin layer may be brought into close contact with an image receiving layer in the course of transferring, or an intermediate layer is provided for the purpose of enhancing the adhesiveness between an adhesion layer and the stripping layer. The thickness of the intermediate layer is normally 0.2 to 3.0 μm and preferably 0.3 to 2.0 μm.

It is preferable that the intermediate layer of the protective layer transfer sheet contains thermoplastic resins which are represented, especially, by styrene-butadiene-styrene (SBS) which is a block-copolymer having a polystyrene moiety and a hydrogenized polyolefin moiety and block-copolymers such as styrene-isoprene-styrene (SIS), styrene-ethylene/butylene-styrene (SEBS), styrene-ethylene/propylene-styrene (SEPS), styrene-ethylene-propylene (SEP). Concretely, Califlex TR, Kraton D and G series manufactured by Shell Co., and Taftec H and M series manufactured by Asahi Kasei Co. are given.

In addition to the foregoing, compositions for hot melt adhesives including, for example, ethylene-vinyl-chloride copolymer, wax, plasticizer, tackiness-providing agent and filler, compositions for polyvinyl acetate emulsion adhesives, compositions constituting chloroprene adhesives or compositions constituting epoxy resin adhesives are contained, as occasion demands, in the intermediate layer. The intermediate layer is formed by laminating on the image-protecting transfer sheet through the conventional coating method. Among those mentioned above, the one containing tackiness-providing agent is preferable.

An added amount of thermoplastic resins contained in an adhesion layer of the protecting layer transfer sheet is normally 5% to 98% and preferably 10% to 95%. Further, an added amount of tackiners to be added to the protective layer of the protective layer transfer sheet is normally 1% to 80% and preferably 5% to 60%. The added amounts mentioned above are all represented by a percentage by weight. The thickness of the adhesion layer is normally 0.2 to 4.0 μm and preferably 0.3 to 3.0 μm.

In transferring the resin layer for image protection from the transfer sheet onto the image receiving layer, preferred means are those capable of applying heat and pressure simultaneously; examples thereof include a thermal head, a heat roller and a hot stamping machine. Among them, a thermal head and a heat roller are particularly preferred in the embodiment of the invention.

Active Energy Ray Curable Resin Layer

A coating liquid for forming an active energy cured resin layer may be formed by the compositions whose main constituents are UV-curable prepolymer and a polymerization-initiator.

As a UV-curable prepolymer, there may be given a prepolymer wherein two or more epoxy groups are contained in a molecule. As a prepolymer like this, there may be given, for example, alicyclic polyepoxides, polybasic acid polyglycidyl esters, polyhydric alcohol polyglycidyl ethers, polyoxyalkyleneglycol polyglycidyl ethers, aromatic polyol polyglycidyl ethers, hydrogen-added compounds of aromatic polyol polyglycidyl ethers, urethane polyepoxy compounds and epoxidation polybutadienes. These prepolymers may be used independently or in combination of two or more kinds.

It is preferable that the content of prepolymers each having two or more epoxy groups in a molecule in a coating agent is 70% by weight or more.

As the polymerization initiator mentioned above, a cation polymerization-starting agent is preferable, and an aromatic onium salt may be given concretely.

As the aromatic onium salt mentioned above, there may be given a salt of an element belonging to Va group in a periodic table, for example a phosphonium salt such as triphenyl-phenacylphosphonium hexafluorophosphate, a salt of an element belonging to Va group, for example, a sulfonium salt such as triphenylsulfonium tetrafluoroborate, triphenylsulfonium hexafluorophosphate, tris hexafluorophosphate (4-thiometoxyphenyl), sulfonium and triphenylsulfonium hexafluoro-antimonate, and a salt of an element belonging to VIIa group, for example, an iodonium salt such as diphenyliodonium chloride.

Technologies for using the aromatic onium salt mentioned above as a cation polymerization-starting agent in polymerization of epoxy compounds are disclosed in U.S. Pat. Nos. 4,058,401, 4,069,055, 4,101,513 and 4,161,478.

As a preferable cation polymerization initiator, there may be given sulfonium salt of an element in VIa group. Among them, triarylsulfonium hexafluoroantimonate is preferable from the viewpoint of storage stability of UV-curable compositions.

The content of cation polymerization intiator in coating agents is preferably 3 to 20% by weight, and the content of 5 to 12% by weight is especially preferable. When the amount of the cation polymerization initiator is not more than 1% by weight of the coating agents, the speed of setting sometimes becomes extremely low when irradiating with ultraviolet rays, which is not preferable.

As UV-curable resins, radical polymerization resins such as, for example, mono-functional or polyfunctional acrylate compounds may further be given.

The coating liquid may further contain surface active agents such as oils, silicone oil, in particular, and silicone alkylene oxide copolymer, for example, L-5 410 marketed by Union Carbide Co., and fluorocarbon surface active agents such as silicone-oil-containing aliphatic epoxide, FO-171 and FO-430 both marketed by 3M and Megafac F-141 marketed by Dai-Nippon Ink Co.

Furthermore, vinyl monomers such as, for example, styrene, paramethyl styrene, methacrylate and acrylate, and monoepoxides such as celluloses, thermoplastic polyester, phenylglycidyl ether, silicon-containing monoepoxide, and butylglycidyl ether may be contained in the coating agents within a range that does not impede the effect of the invention.

In addition, the coating liquid may further contain fillers such as talc, calcium carbonate, alumina, silica, mica, barium sulfate, magnesium carbonate and glass, wettablility improving agents such as dyes, pigments, thickening agents, plasticizers, stabilizers, leveling agents, coupling agents, tackiness-providing agents, silicon-group-containing active agents and fluorocarbon-group-containing surface active agents and other various additives as an inactive component. For the purpose of improving the fluidity of the coating agent in the course of coating, the coating agent may contain a small amount of solvent that hardly react on the aforementioned cation polymerization-starting agent such as acetone, methyl ethyl ketone and methyl chloride.

EXAMPLES

EXAMPLE 1

Sublimation Ink Sheet for Thermal Transfer Recording

The following coating solution for ink layer formation was coated, by the wire bar coating method, on a 6 μm thick polyethylene terephthalate film support (Lumirror 6CF531, Toray Industries, Inc.) oppositely with the heat resistant protective layer so as to give a dry coating thickness of 1 mm, followed by drying. Thus, an ink sheet for thermal transfer recording was prepared.

| Coating Solution for Ink Layer Formation | |
|---|---|
| Disperse dye (Kayaset Blue 136, Nippon Kayaku, Co., Ltd.) | 4.0 parts |
| Polyvinyl butyral (Eslec BX 1, Sekisui Chemical Co., Ltd.) | 4.0 parts |
| Methyl ethyl ketone | 82 parts |
| Cyclohexanone | 10 parts |

Image Receiving Element

Subsequently, on the corona treated side of a support prepared by extrusion laminating a white pigment containing polypropylene resin to 50 μm on both sides of a 350-μm thick polyethylene terephthalate sheet (Melinex 226, ICI) was formed an image receiving layer comprising a 0.5 μm thick anchoring layer, a 4-μm thick lower layer and a 0.5-μm thick upper layer by coating and drying one by one the following coating solution for anchoring layer formation, coating solution for lower layer formation and coating solution for upper layer formation, using the wire bar coating method. Thus, a card-shaped image receiving element was prepared.

| Coating Solution for Anchoring Layer Formation | |
|---|---|
| Polyvinyl acetoacetal (Eslec BL 1, Sekisui Chemical Co., Ltd.) | 9 parts |
| Isocyanate (Coronate HX, Nippon Polyurethane Ind., Co., Ltd.) | 1 part |
| Methyl ethyl ketone | 80 parts |
| n-Butyl acetate | 10 parts |
| **Coating Solution for Lower Layer Formation** | |
| Polyvinyl butyral resin (Eslec BX 1, Sekisui Chemical Co., Ltd.) | 10 parts |
| Methyl ethyl ketone | 80 parts |
| n-Butyl acetate | 10 parts |
| **Coating Solution for Upper Layer Formation** | |
| Polyacrylate emulsion (43% solid) (AD 51, Kanebo NSC Co., Ltd.) | 25 parts |
| Polyethylene wax emulsion (35% solid) (Hytec E100, Toho Kagaku Kogyo Co., Ltd.) | 5 parts |
| Water | 70 parts |

Plastic film partially having heat fusible ink layer

On the reverse side of the antisticking layer provided on a polyethylene terephthalate film support (Lumirror 6CF531, Toray Industries, Inc.) was formed, in pattern, comprising a peeling layer and a heat fusible ink layer, by coating the following coating solutions so as to give a peeling layer thickness of 0.3 μm and a heat fusible ink layer thickness of 0.9 μm by use of the gravure coating method.

| Coating Solution for Peeling Layer | |
|---|---|
| Ethylene vinyl acetate copolymer (Evaflex EV210, Mitsui DuPont Polychemical Co., Ltd.) | 0.3 part |
| Carnauba wax | 9.7 parts |
| Solvent (methyl ethyl ketone:methyl isobutyl ketone = 1:1) | 90.0 parts |
| **Coating Solution for Heat Fusible Layer** | |
| Ethylene vinyl acetate copolymer (Evaflex EV40Y, Mitsui DuPont Polychemical Co., Ltd.) | 1 part |
| Carbon black | 6.0 parts |
| Phenolic resin (Tamanol 526, Arakawa Kagaku Kogyo Co., Ltd.) | 13.0 parts |
| Methyl ethyl ketone | 80.0 parts |

Subsequently, the above sublimation ink sheet for thermal transfer recording and image receiving sheet were positioned so as to have the ink layer of the former and the image receiving layer of the latter contacting each other. Then, image recording was carried out, so as to form a 5-mm lattice patterned image in 2 cm×3 cm rectangle, by applying heat, with a first thermal head, to the support side of the sublimation ink sheet for thermal transfer recording under the conditions of output: 0.4 W/dot, pulse cycle: 20 mse, pulse width: 10 msec and dot density: 12 dots/mm.

Using an ink sheet having the above sublimation dye, image formation was carried out as above in unit 1 of the equipment used in the invention which is shown in FIG. 1. Then, the image receiving element was sent by conveyor rollers to unit 2.

Figure 7:
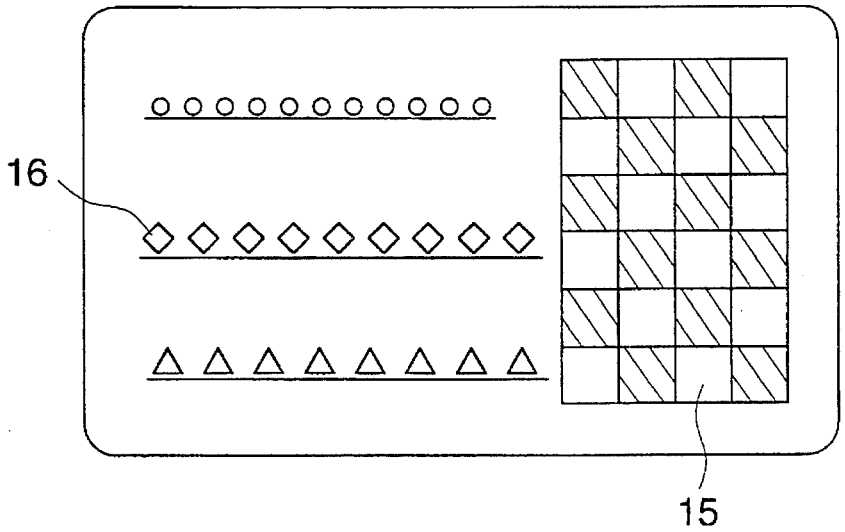
FIG. 7 shows an example of image recording and character recording carried out according to the invention.

In unit 2, the image receiving layer surface carrying the transferred sublimation dye image was contacted with the surface of the plastic film partially having the heat fusible ink layer in pattern and the image portion of the image receiving layer was heated by a second thermal head of the same type as that in unit 1 through the part of the plastic film without heat fusible ink layer under conditions of output of 0.4 W/dot, pulse cycle of 20 msec and pulse width of 12 msec. Simultaneously, the portion of the plastic film with the heat fusible ink layer was heated imagewise to form character images as shown in FIG. 7 on the image receiving layer under conditions of 0.4 W/dot, pulse cycle of 20 msec and pulse width of 2 msec. In FIG. 7, 16 is the character image formed of the heat fusible ink and 17 is the lattice pattern formed of the sublimation dye.

COMPARATIVE EXAMPLE 1

Figure 8:
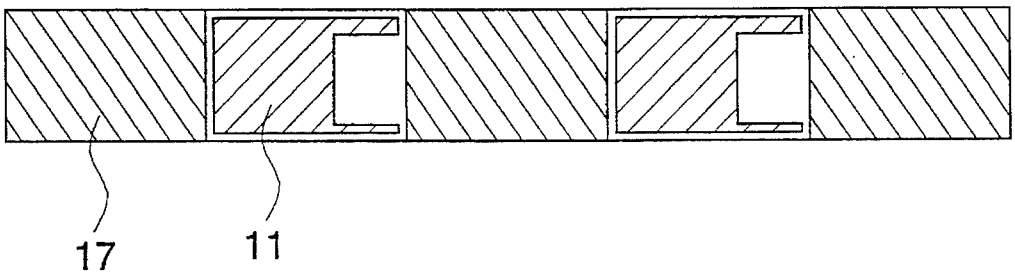
FIG. 8 shows the ink sheet used in Comparative Example.

Using a face sequential ink sheet having an ink layer containing a sublimation dye 17 and a patterned heat fusible ink layer 11 alternately as shown in FIG. 8, image formation was carried out as above in unit 1 of the equipment of FIG. 2 and, after forming an image, the image receiving body was returned to the original position before printing by rotating the platen roller reversely. Then, heating the transferred sublimation dye image and a heat fusible ink image formation were carried out in unit 1, as shown in FIG. 7, under conditions the sample as that applied in unit 2 in Example 1.

Ten cards each of samples prepared in Example 1 and Comparative Example 1 were subjected to continuous printing for purposes of measuring the whiteness of non-imaging portion in the sublimation dye image portion and comparing the time required in such continuous processing.

Evaluation Method

Heat Accumulation

The red light reflective density in the non-heated portion (non-image portion) was measured with a Konica PDA 65 densitometer on 10 cards each of the samples, which were continuously processed using the same thermal head.

Time Required

The time from the start of conveying the 1st card to the completion of discharging the 10th card was measured.

The results of the evaluation are shown below:

| Card No. | Reflective Density: The Same Head (Comparison) | Reflective Density: Separate Head (Invention) |
|---|---|---|
| 1 | 0.08 | 0.08 |
| 2 | 0.08 | 0.08 |
| 3 | 0.09 | 0.08 |
| 4 | 0.10 | 0.08 |
| 5 | 0.12 | 0.08 |
| 6 | 0.14 | 0.08 |
| 7 | 0.17 | 0.08 |
| 8 | 0.20 | 0.08 |
| 9 | 0.20 | 0.08 |
| 10 | 0.21 | 0.08 |
| Time Required | 224 sec | 107 sec |

As is apparent form the above results, unnecessary density transfer or fog forms in the non-imaging portion due to accumulation of heat in a heating resistor, when image formation and heat treatment are performed with the same thermal head. On the contrary, when image formation and heat treatment are carried out using different thermal heads according to the invention, the processing speed can be increased and thereby the quality of the image can be improved.

EXAMPLE 2

Figure 4:
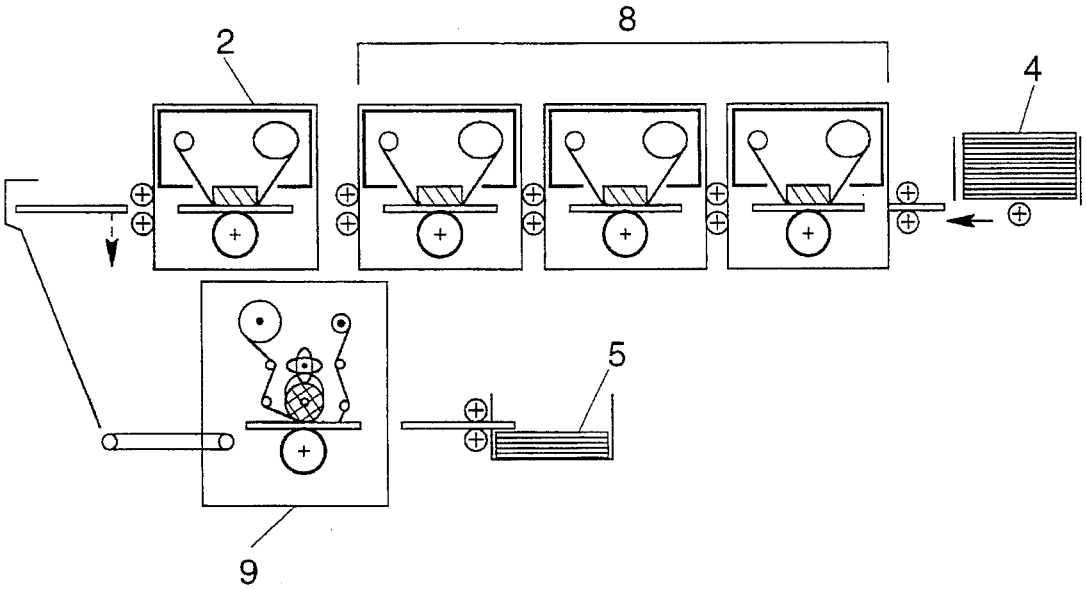
FIG. 4 is a schematic diagram of the image treating method of the invention employing an additional unit for transferring a thermal transfer protective layer.
Figure 5:
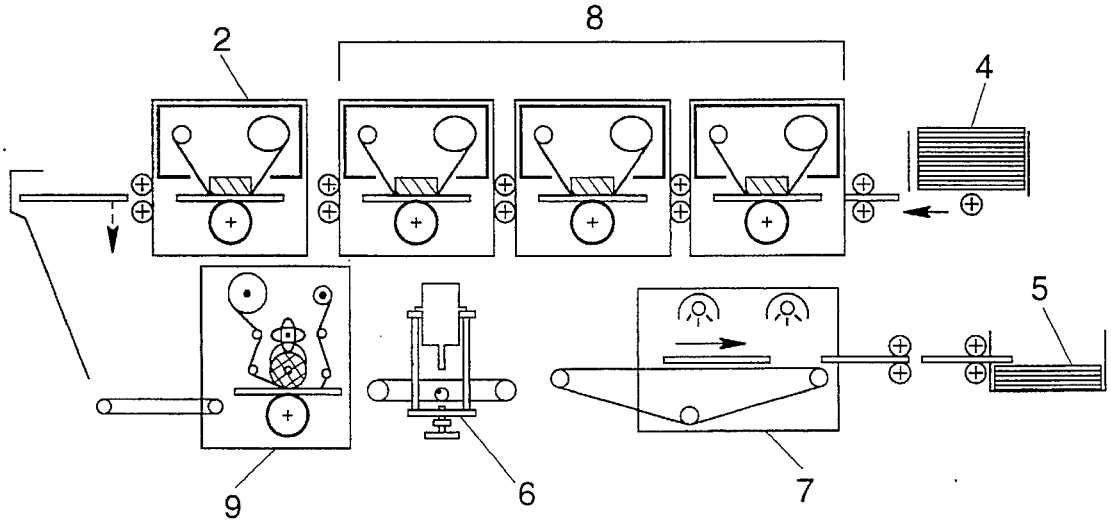
FIG. 5 is a schematic diagram of the image treating method of the invention employing additional units for the formation of an active energy ray curing resin layer and for the transfer of a thermal transfer protective layer.

Using the equipment shown in FIG. 4, a person's color image was formed in the sublimation dye image forming portion using three sublimation ink sheets of yellow, magenta and cyan and, then, heat treatment and heat fusion character image formation were carried out in unit 2 in the same manner as Example 1. Subsequently, a protective layer was transferred onto the whole surface of the image receiving element by superposing on it a transfer protective layer sheet comprising a 25-μm thick polyethylene terephthalate film (T 25, manufactured by Diafoil-Hoechst Co.) having a transparent thermoplastic transfer layer of the following composition, applying heat and pressure thereto using hot stamping machine 9 having a 5-cm diameter silicone rubber roller (hardness of the rubber: 80) heated to 190° C. at the surface so as to give a line pressure of 10 kg/cm and a transfer speed of 15 mm/sec, and removing the polyethylene terephthalate film. Transfer Sheet for Image Protection Layer Formation A protective layer transfer sheet was prepared by coating, on one side of polyethylene terephthalate film (S 25, manufactured by Diafoil-Hoechst Co.), the following coating solutions so as to give a 0.7-mm thick peeling layer and a 1.0-mm thick thermoplastic layer using the wire bar coating method.

| Coating Solution For Peeling Layer | |
|---|---|
| Acrylic resin (Dianal BR 87, Mitsubishi Rayon Co., Ltd.) | 9 parts |
| Silicone resin fine particles (Tosperl 120, Toshiba Silicone Co., Ltd.) | 1 part |
| Methyl ethyl ketone | 40 parts |
| Toluene | 50 parts |
| **Coating Solution for thermoplastic Layer** | |
| Styrene type resin (Kraton G 1726, Shell Chemical Co.) | 9 parts |
| Hydrogenated petroleum resin (Escorez 5320HC, Tonex, Co. Ltd.) | 1 part |
| Toluene | 60 parts |

The finished image receiving element did not show any image deterioration even when its surface was rubbed with an applicator soaked with 50% aqueous solution of ethanol.

EXAMPLE 3

Using the equipment of FIG. 3 obtained by adding ultraviolet curing resin coating unit 6 and ultraviolet ray irradiation unit 7 to the equipment used in Example 1, the following ultraviolet curing resin containing coating solution was coated so as to give a coating weight of 20 g/m$^2$ with a gravure coater, and then the coating solution was cured under the following curing conditions to form an ultraviolet cured resinous protective layer.

To examine the influence of sublimation dye on curing properties, the surface condition of ultraviolet cured resin on the image receiving body was observed on two samples: one employed the sublimation dye used in Example 1 and the other employed the following sublimation dye instead of that used in Example 1.

| Ultraviolet Curing Resin Containing Coating Solution | |
|---|---|
| Side chain type bisphenol A glycidyl ether | 15 parts |
| 3,4 Epoxycyclohexylmethyl 3,4 epoxycyclohexane corboxylate | 70 parts |
| Trimethlolpropane triglycidyl ether | 15 parts |
| Aromatic sulfonium salt type UV initiator | 6 parts |

Curing Conditions

Irradiation source: high pressure mercury lamp of 60 W/m$^2$

Irradiation distance: 10 cm

Irradiation mode: light scanning at 3 cm/sec

Sublimation Dye: 3,3' diethyl 2,2' thiazolinocarboxyanine iodide

Evaluation Results

The image portion using the sublimation dye of Example 1 gave a slightly wet and sticky feeling, but the image portion using the above dye was glossy and covered with a completely cured coating.

EXAMPLE 4

Using the equipment of FIG. 5 obtained by adding ultraviolet curing resin coating unit 6 and ultraviolet ray irradiation unit 7 used in Example 3 to the equipment used in Example 2, there was prepared a image receiving body laminated with an image protection resin layer and an ultraviolet cured resin layer in this order.

The finished image receiving body did not show any image deterioration when rubbed with an applicator soaked with 50% aqueous solution of ethanol, and its ultraviolet cured resin layer was a completely cured glossy one.

What is claimed is:

1. A method for treating a series of thermally transferred images comprising the steps of serially transferring images from the ink layer of a sublimation ink sheet which comprises a support and an ink layer comprising a sublimation dye provided on the support, to a respective surface of a series of image receiving layers of a series of image receiving elements each of which comprises a support and an image receiving layer provided on the support, by means of imagewise heating by a first thermal head, and, subsequently serially heating the surface of each image receiving layer having the transferred sublimation dye image with an amount of thermal energy of 25 mJ/mm$^2$ to 500 mJ/mm$^2$ by a second thermal head through a plastic film serially contacted to the surface of each said image receiving layer.

2. The method of claim 1, wherein said plastic film has a layer having an antisticking layer on the surface to be faced said second thermal head.

3. The method of claim 1, wherein said plastic film partially has a thermally fusible ink layer on the surface thereof to be faced to said image receiving layer, and the steps of transferring an image of said thermal fusible ink by means of imagewise heating the part of said plastic film having said thermal fusible ink layer from the side opposite to said thermal diffusible ink layer by said second thermal head, and heating the surface of said image receiving layer having the transferred images through the part of said plastic film having no thermal fusible ink layer by means of said second thermal head.

4. The method of claim 1, wherein a layer of an active ray curable resin layer is provided on the surface of each of said image receiving layers after heating by the second thermal head and is cured to form a protective layer.

5. The method of claim 1, wherein a layer of a thermoplastic resin is thermally transferred from a protective layer transfer sheet which comprises a support and a substantially transparent thermoplastic layer provided on the support, to the surface of each of said image receiving layers to form a protective layer after heating by the second thermal head.

6. The method of claim 5, wherein a layer of an active ray curable resin layer is further provided on the surface of said thermoplastic layer transferred on each of said image receiving layers and is cured to form an outer protective layer.

* * * * *